US007303519B2

(12) United States Patent
Jenkins et al.

(10) Patent No.: US 7,303,519 B2
(45) Date of Patent: Dec. 4, 2007

(54) AUTOMATIC MACHINE AND METHOD FOR FORMING A CORRUGATED PALLET

(75) Inventors: George Jenkins, Statesboro, GA (US); Michael Olvey, Statesboro, GA (US)

(73) Assignee: Palletkraft North America Corp., Sylvania, GA (US)

( * ) Notice: Subject to any disclaimer, the term of this patent is extended or adjusted under 35 U.S.C. 154(b) by 0 days.

(21) Appl. No.: 11/222,478

(22) Filed: Sep. 8, 2005

(65) Prior Publication Data

US 2007/0066474 A1 Mar. 22, 2007

(51) Int. Cl.
*B31B 1/26* (2006.01)

(52) U.S. Cl. ..... 493/399; 493/128; 493/160

(58) Field of Classification Search ..... 493/60, 493/68, 88, 177–181, 127, 128, 160, 161, 493/397, 399, 402, 964
See application file for complete search history.

(56) References Cited

U.S. PATENT DOCUMENTS 3,978,773 A * 9/1976 Pinto ..... 493/438
4,200,032 A * 4/1980 Roda ..... 493/451
5,533,954 A * 7/1996 Zogg ..... 493/310
5,807,225 A * 9/1998 Nowacki et al. ..... 493/167
6,029,582 A 2/2000 Ogilvie, Jr. et al. ..... 108/51.3
6,159,137 A * 12/2000 Lee et al. ..... 493/355
6,913,164 B2 * 7/2005 Duquette ..... 220/528
6,944,928 B1 * 9/2005 Johansson ..... 29/430

* cited by examiner

*Primary Examiner*—Hemant M. Desai
(74) *Attorney, Agent, or Firm*—Harold L. Marquis; George M. Thomas; James W. Kayden

(57) ABSTRACT

A folding and gluing machine is provided for converting a corrugated blank into a panel having at least two parallel struts formed from the blank. The machine forms the struts by having compression chains on each side that exert pressure on the sides of the blank so that struts are formed along weaken lines that have been formed in the blank by a slitter. The struts are formed along an L shaped anvil which has creasing rollers to start the formation of the struts. Each strut is composed of two legs which are glued together. The slitter may be incorporated as a part of the folding and gluing machine.

13 Claims, 9 Drawing Sheets

AUTOMATIC MACHINE AND METHOD FOR FORMING A CORRUGATED PALLET

FIELD OF THE INVENTION

This invention relates to an automatic machine and method for forming the top member and bottom member of a corrugated pallet, such as the one disclosed in U.S. Pat. No. 6,029,582 (Olvey) ('582). The machine and method of this invention can be used to produce the top and bottom panels for a corrugated pallet.

BACKGROUND OF THE INVENTION

The '582 patent discloses a corrugated paperboard pallet. This corrugated pallet is produced by nesting and gluing together a top and bottom panel, each of which has struts that have been glued together. A corrugated pallet of the '582 patent can be constructed by manually folding and gluing the top and bottom panels to form the struts, and then gluing the top and bottom panels together to form the corrugated pallet. This operation is labor intensive and difficult.

It is an object of this invention to develop an automatic machine and method for automatically folding struts in a corrugated blank and gluing them together to form the top and bottom panels of the corrugated pallet of the '582 patent. The corrugated pallet of the '582 patent has a flat elevated surface to support a load a sufficient distance from the floor to permit the forks of a forklift to be inserted into openings between the top and bottom panels so that the pallet with the load can be moved from place to place.

SUMMARY OF THE INVENTION

The present invention provides an automatic machine and method for forming the top and bottom panels for a corrugated pallet from a corrugated blank. This folding and gluing machine can fold and form from two to six struts in a corrugated blank and glue the struts together to form a top or a bottom panel for a corrugated pallet. The machine may have a slitter section in which weaken lines are impressed in the corrugated blank to facilitate the folding to form two legs of a strut in the blank. While the slitting operation can be performed separately, it is preferred that the slitter be incorporated as a section of the folding and gluing machine.

The slitter has four rollers in sets through which the corrugated blank is processed. Sets of corresponding male and female dies form a weakened line on the top and bottom sheets of the blank to facilitate the formation of a 90° angle in the paperboard for forming a leg of a strut. The other set of rollers of the slitter has a male die on one roller and a flat mandrel on the other roller for forming a weakened line in the top sheet of the blank to that facilitate a 180° angle between the two legs of a strut. The male die for forming the weakened lines for the 180° angle consists of two closely spaced male dies.

The corrugated blank in which the weakened lines are formed is transported by a conveyor or other means to a folding and gluing section of the machine for forming and gluing the struts in the corrugated blank. The folding and gluing section basically operates by exerting pressure on the sides of the corrugated blank to force the folding of the blank along the weakened lines formed by the slitter. A side compression chain on each side of the folding and gluing section is tapered inwardly from the front to the back of the machine to exert pressure on the sides of the corrugated blank as it travels through the machine. A creasing wheel or wheels is provided to start the downward movement of the area between the weakened lines to form a strut. The side compression chains, which are tapered inwardly from the front to the back of the machine, provide the pressure to finish the formation of the struts. The inside surfaces of the legs of each strut are glued together and held together by the side compression chains until the glue sets as the blank travels through the machine. The machine has a conveyor belt for transporting the blank through the machine. This conveyor belt may have apertures which are connected to a vacuum plenum to help hold the corrugated blank to the conveyor belt. Roller beds or plates may be used to keep the corrugated blank in the same plane as the struts are being formed.

The first section of the machine may form two or more struts that can run from one end of the blank to the other end. The struts may have openings to permit the entry of a forklift to lift the pallet. After finishing the processing through the first folding and gluing section, the corrugated blank may be transported by a conveyor belt to a second folding and gluing section to form additional struts before finally exiting the machine. The second folding and gluing section operates in the same way as the first folding and gluing section.

It is important that the struts be perpendicular to the plane of the corrugated blank in order to form a corrugated pallet that will adequately support a load. If the strut is at an angle other than 90°, the corrugated pallet may not support a heavy load. Consequently, an L shaped anvil is provided that extends in the longitudinal direction of the machine for forming each strut. Rollers may be provided above the anvil to help hold the corrugated blank in the same plane and to facilitate the proper folding of the corrugated blank to form the strut.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

DETAILED DESCRIPTION OF THE PREFERRED EMBODIMENT

The present invention provides a machine for folding and gluing a corrugated blank having a top, bottom, two sides and two ends into a top or bottom corrugated panel for constructing a corrugated pallet. The corrugated pallet is constructed of two or more panels formed from corrugated paperboard blanks 16A. As used herein, "paperboard" refers to a web of cellulosic fibers in sheet form. The term paperboard includes paper and paperboard of different thicknesses. The preferred paperboard is virgin kraft paperboard of a weight known as linerboard. A corrugated sheet of paperboard can be formed on a corrugator by corrugating one sheet of paperboard and gluing it between two other sheets. The corrugated paperboard can have two or more corrugated sheets between a number of flat sheets of paperboard.

The corrugated paperboard for forming the corrugated pallets can have a surface treatment to improve its moisture resistance, such as the surface treatment described in the '582 patent, or the paperboard may be coated with wax.

Figure 1A:
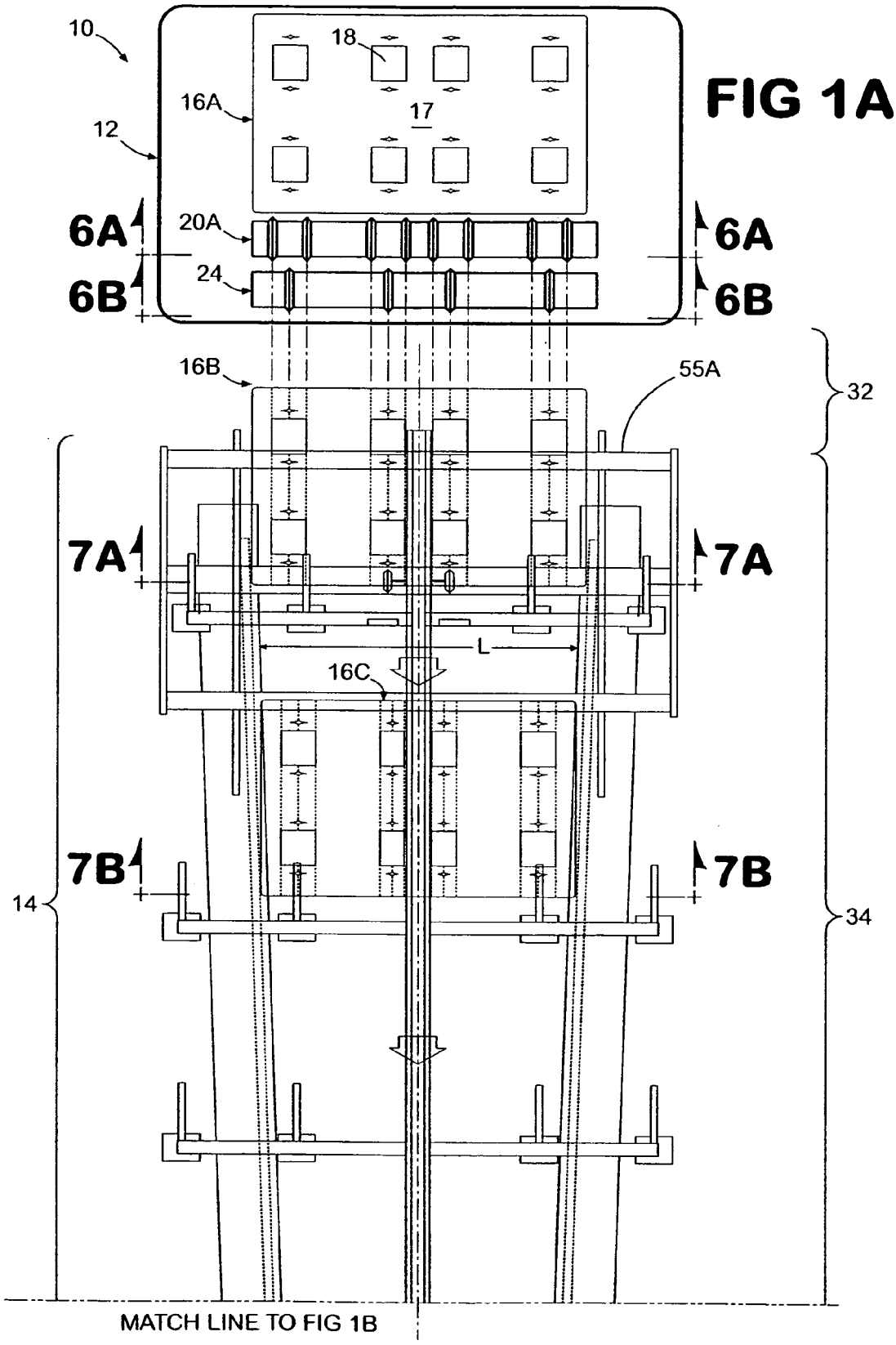
FIGS. 1A-B is a schematic top view of the folding and gluing machine of this invention which includes a slitter.
Figure 1B:
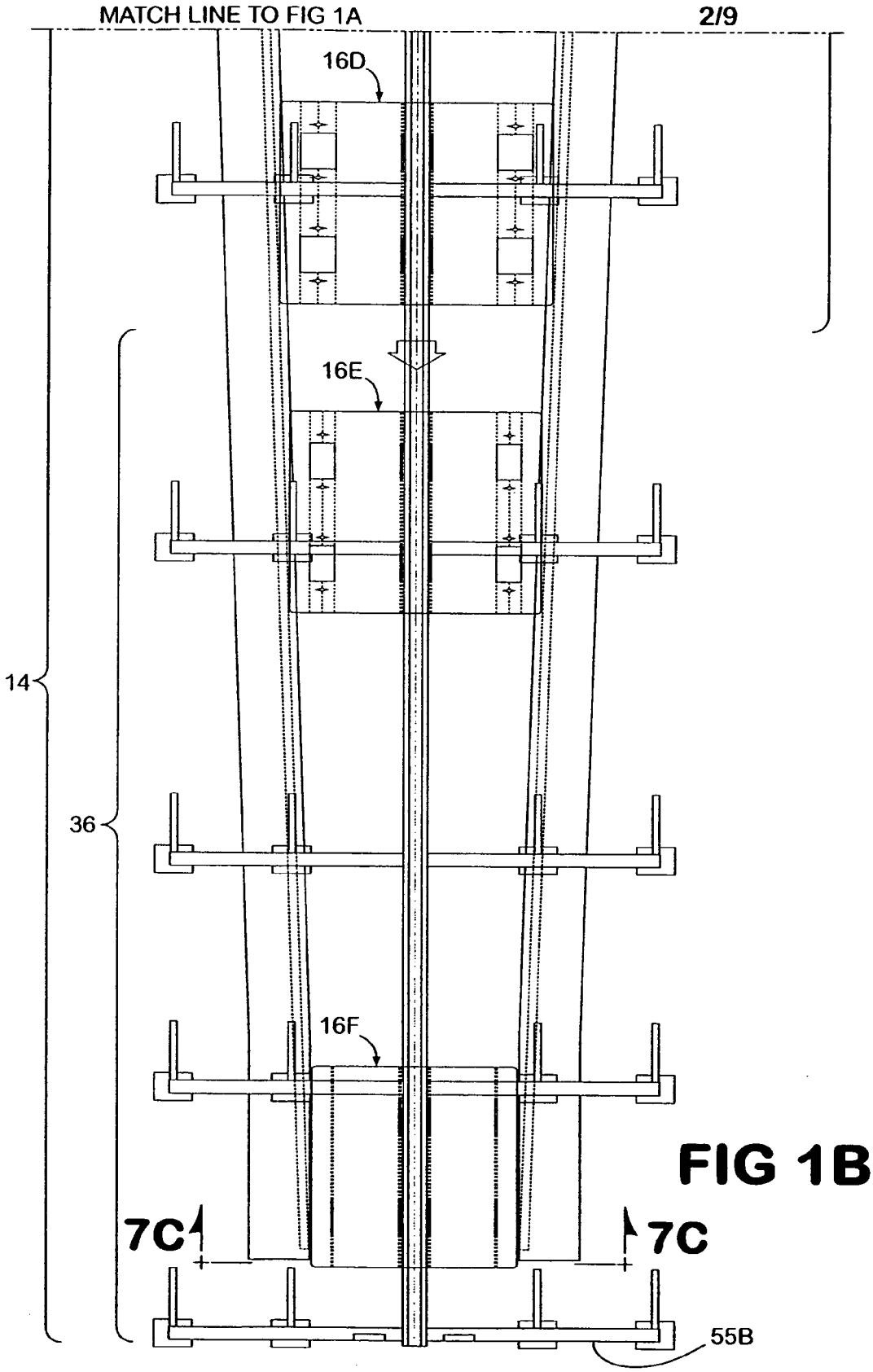

A top view of the corrugated panel forming machine 10 is illustrated in FIGS. 1A-1B. A corrugated blank 16A is cut from a roll of corrugated paperboard into a blank of the desired size and configuration for forming the top or bottom panel for a corrugated panel. The corrugated blank 16A may have one or more apertures 18 which form an aperture in a strut in the blank through which the fork of a forklift can be extended to lift the load and the pallet. The corrugated blank 16A needs to have weakened lines formed in the top sheet 17 of the corrugated blank 16A and preferably also on the bottom sheet 19 (shown in FIG. 3A) These weakened lines can be formed by a slitter or other types of machine in the blank 16A prior to being folded and glued into struts in the strut forming sections 14 of corrugated panel forming machine 10. Preferably the corrugated blank 16A has weakened lines impressed by a slitter section 12 which is preferably a part of the corrugated panel forming machine 10.

Figure 2A:
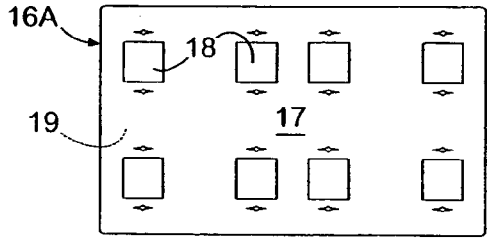
FIGS. 2A-F is a top view of a corrugated blank as it is processed by the machine of FIG. 1 into a panel for a corrugated pallet.
Figure 2B:
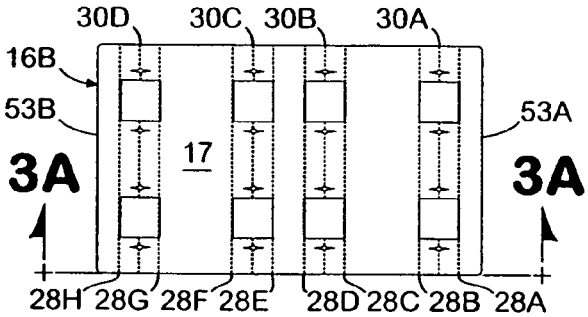
Figure 2C:
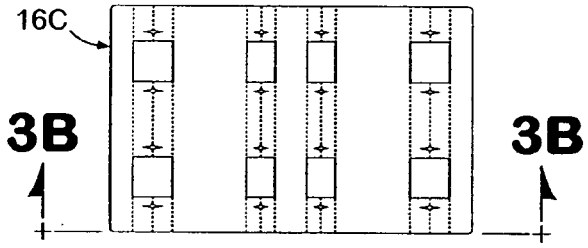
Figure 6A:
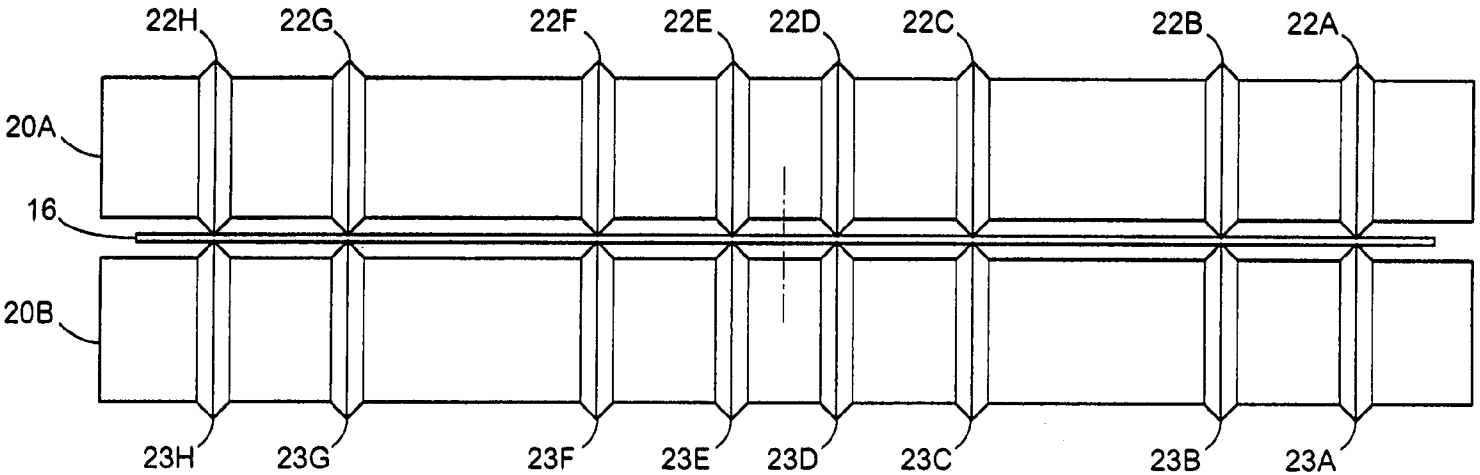
FIG. 6A is a front view of the pair of rollers with the female dies on the top roller and the male dies on the bottom roller for making the weakened lines in the corrugated blank for forming a 90° angle taken along line 6A-6A as shown in FIG. 1A.

The slitter section 12 has two slitter rollers 20A-B with 90° female dies 22A-H and 23A-H as shown in FIGS. 1A and 6A for forming the weakened lines in the top sheet 17 and bottom sheet 19 (shown in FIG. 3A) of the corrugated blank 16A for forming the struts in the corrugated blank. As the corrugated blank 16A passes between slitter rollers 20A-B the female dies 22A-H on slitter roller 20A form the weakened lines in the top sheet 17 of the corrugated blank 16A as shown in FIG. 2B. The 90° female dies 23A-H of slitter roller 20B make the weakened lines in the bottom sheet 19 (shown in FIG. 3A) of the corrugated blank 16A.

Figure 3A:
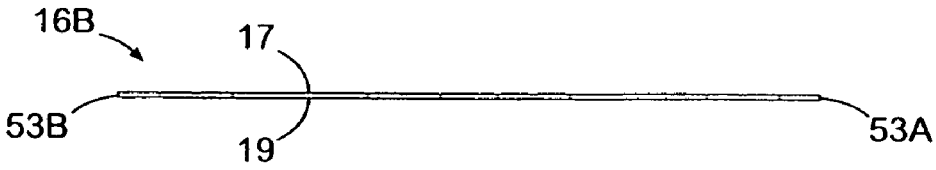
FIGS. 3A-E is a cross section view of the blank shown in FIG. 2A-F as it is folded into a panel in the machine of FIG. 1.
Figure 3B:
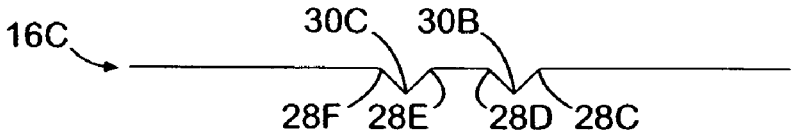
Figure 3C:
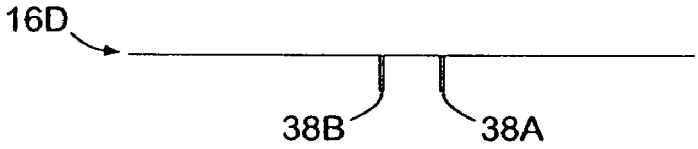
Figure 3D:
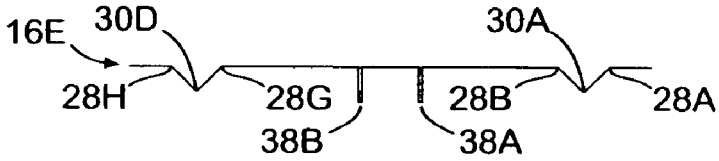
Figure 3E:
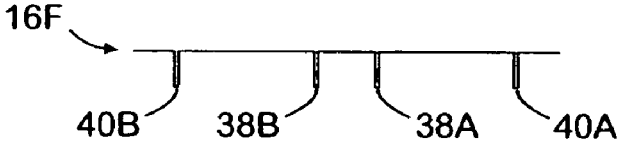
Figure 6B:
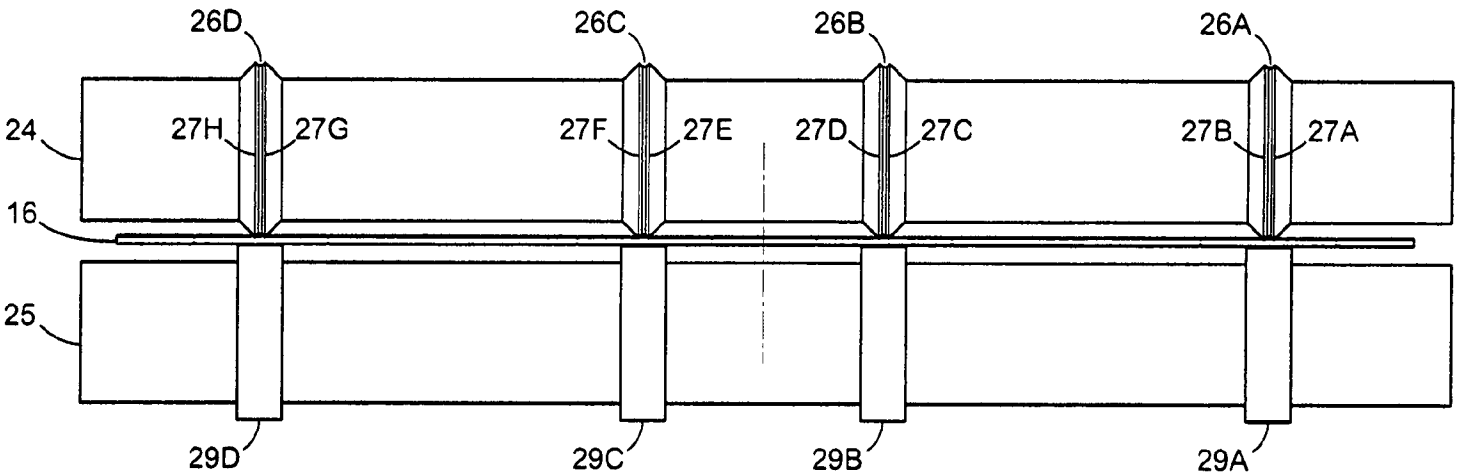
FIG. 6B is a front view of the pair of rollers with the male dies for making the weakened line for forming a 180° fold line in the corrugated blank taken along line 6B-6B as shown in FIG. 1A.

The corrugated blank 16A is then passed between slitter roller 24 with 180° dies and slitter roller 25 with flat mandrels 29A-D as shown in FIGS. 1A and 6B. The slitter roller 24 has 180° male dies 26A-D, each of which has a male member, e.g. 27A-B as shown in FIG. 6B. The male members 27A-B make two weakened lines which are close together in the top sheet 17 of the corrugated blank 16A. Weakened lines may not be needed in the bottom sheet 19. The relationship between the top sheet 17 and bottom sheet 19 is shown in FIG. 3A.

The 90° weakened lines 28A-H formed in the top sheet 17 of the corrugated blank 16A are shown in FIG. 2B and corresponding weakened lines are formed in the bottom sheet 19 of the corrugated blank 16A, but are not shown. The 180° weakened lines 30A-D formed in the top sheet 17 of corrugated blank 16B are also shown in FIG. 2B.

Figure 4:
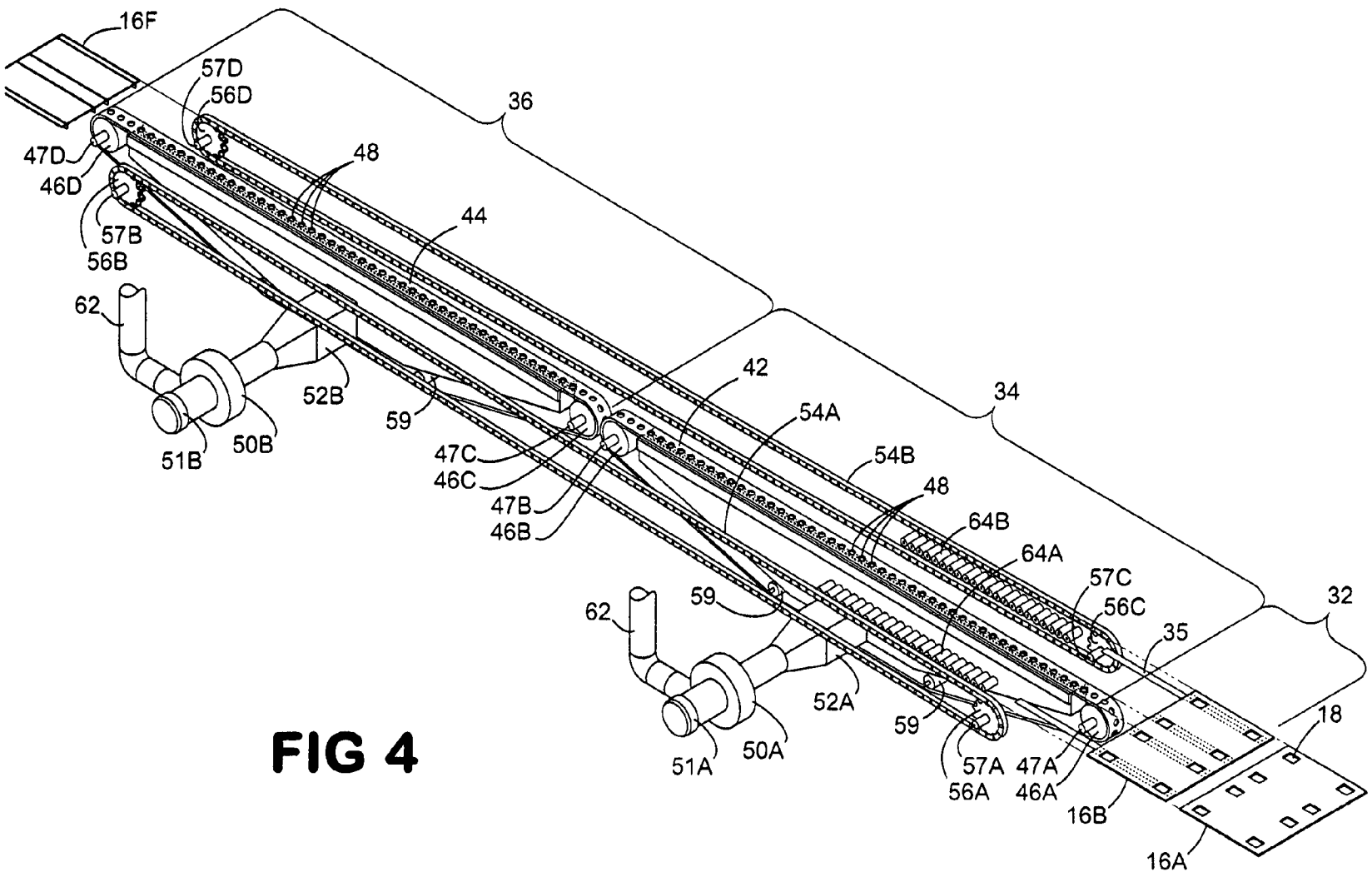
FIG. 4 is a top perspective view of the folding and gluing sections of the machine of FIG. 1.

The corrugated blank 16B is then transferred by transfer section 32 to the first strut forming section 34 for folding and gluing of the struts. The corrugated blank 16B can be transferred from the slitter section 12 to the first strut forming section 34 by a conveyor belt or by simply being pushed forward on a transfer plate or straps 35 as shown in FIG. 4.

This corrugated panel forming machine may have one section for forming struts or may have a second strut forming section 36. Each of these sections may form two or more struts in the corrugated blank 16B.

Figure 2D:
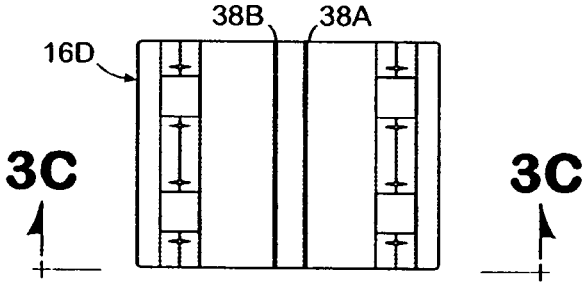
Figure 2E:
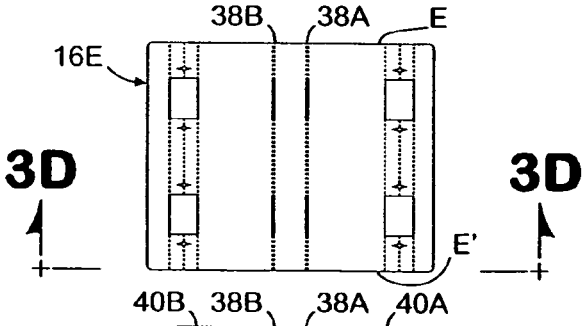

In this first strut forming section 34 an inner set of struts 38A-B are formed as shown in FIG. 2D. A conveyor feed belt 42 is provided for conveying the corrugated blank 16B through the first strut forming section 34. A second conveyor feed belt 44 is provided for conveying the conveying blank 16B through the second strut forming section 36. In this embodiment of the machine 10, the corrugated blank 16B is placed above the conveyor belts 42 and 44. It should be realized that a single conveyor belt could be used and that other means for conveying the corrugated blank 16B through the corrugated panel forming machine 10 could be used.

Figure 5A:
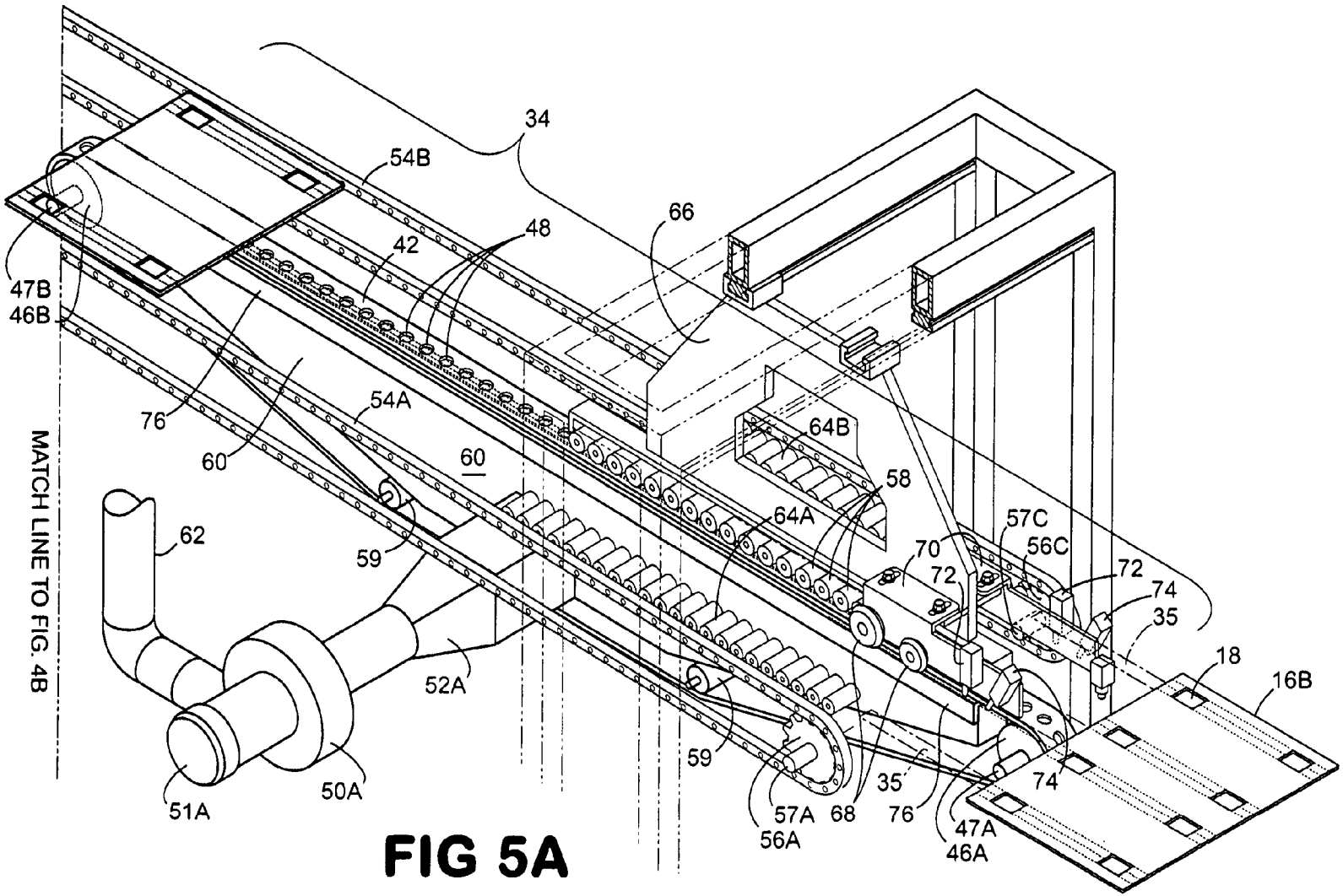
FIG. 5A is a top perspective view of the first folding and gluing section of the machine of FIG. 1 which partially shows the frame for supporting the machine.

The conveyor feed belts 42 and 44 can be moved by belt pulleys 46A-D. Idler wheels 59 are used to keep the proper tension on the conveyor feed belts 42, 44. As illustrated in FIG. 4 the conveyor belts 42, 44 may have vacuum apertures 48 to assist in holding the corrugated blank 16B flat against the conveyor belts 42, 44. Vacuum can be provided by vacuum pumps 50A-B driven by vacuum pump motors 51A-B. A vacuum is established through vacuum ducts 52A-B in communication with the vacuum plenum 60 beneath each conveyor feed belt 42, 44. Exhaust stacks 62 are provided for the removal of air from the vacuum plenum 60 as shown in FIG. 5A.

Figure 5B:
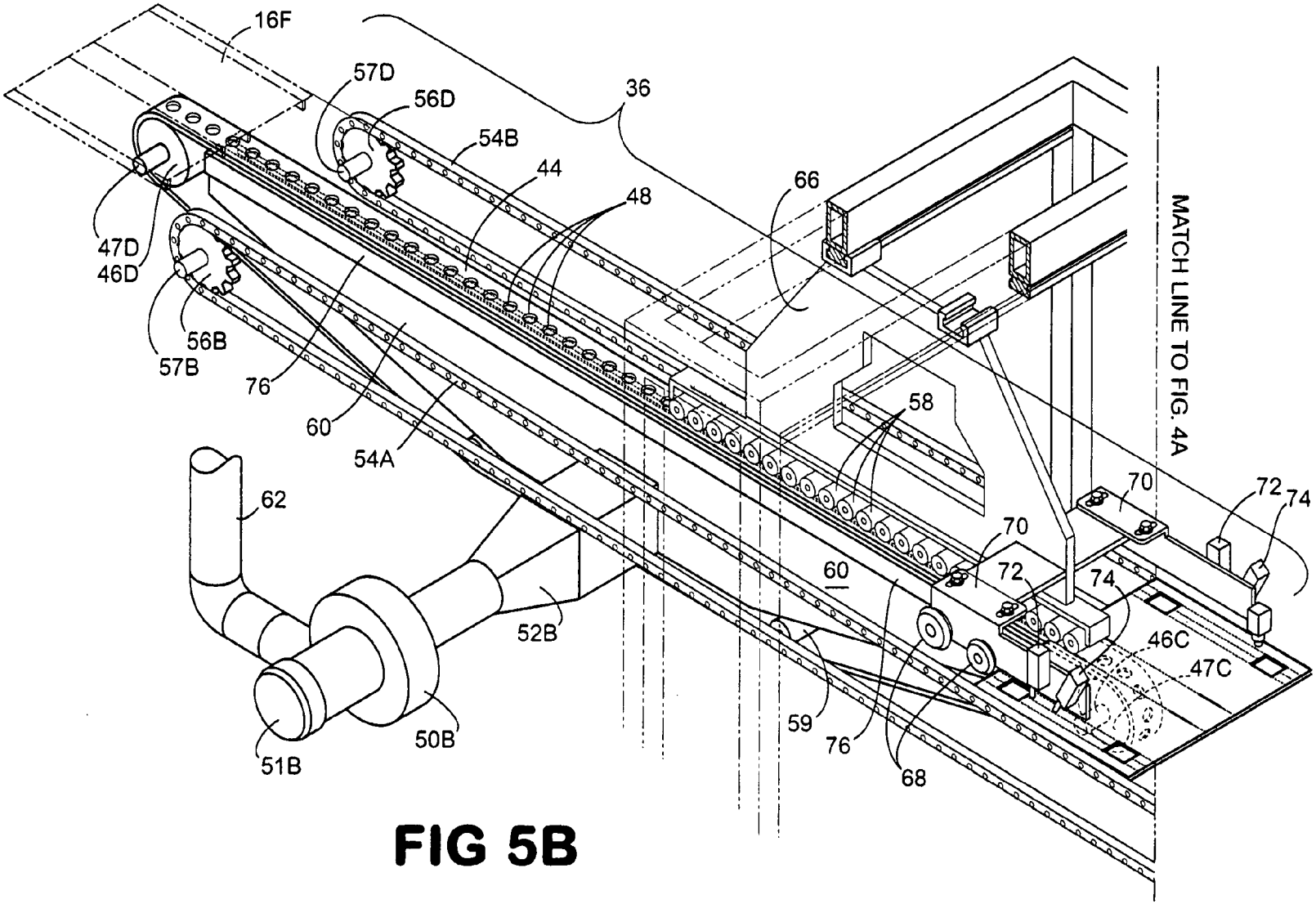
FIG. 5B is a perspective view of the second folding and gluing section of the machine of FIG. 1.

The struts, as illustrated by struts 38A-B in FIG. 2D are formed by compressing the sides 53A-B of the corrugated blank 16B as it is conveyed through the strut forming sections 34, 36 of panel forming machine 10. This is accomplished by two compression chains 54A-B running along each side of the machine from the front 55A to the back 55B of the panel forming machine 10 as shown in FIGS. 5A-B. These compression chains 54A-B are tapered inwardly from the front 55A to the back 55B of the machine to exert pressure on the sides 53A-B of the corrugated blank 16B as it passes through the machine to form the struts as illustrated by 38A-B in FIG. 2D. The compression chains 54A-B are turned by chain sprockets 56A-D which are turned by shafts 57A-D connected to a power source (not shown). In this case a single compression chain 54A-B is shown on each side of the strut forming sections 34, 36 of the panel forming machine 10. It should be realized that two compression chains could be used on each side with one being used for the first strut forming section 34 and the other for the second strut forming section 36. In lieu of the compression chains 54A-B a plate with a low co-efficient a friction which tapers inwardly from the front 55A to the back 55B of the machine 10 could be used. The individuals links of the compression chain 54A-B may have a groove (not shown) to help confine the sides 53A-B of the blank 16B as it is transported through the machine 10. If a low friction plate were used, it could be provided with similar groves to limit the vertical movement of the blank 16B as it is transported through the machine.

In order to keep the corrugated blank 16B in the same plane, except for the struts being formed, during the compression on the sides 53A-B of the blank 16B, it is necessary to keep the rest of the blank in the same plane. This is accomplished in the machine illustrated in FIG. 1 partly by the conveyor feed belts 42 and 44 supporting the corrugated blank 16B and by outside bottom roller beds 64A-B. It should be understood that a plate or other means could be used to support the corrugated blank 16B to keep it in a single plane during the formation of the struts. A conveyor belt 82 or plate can be placed above the corrugated blank 16B to assist in moving the blank and keeping it in a single plane as shown in FIG. 7A.

Figure 7A:
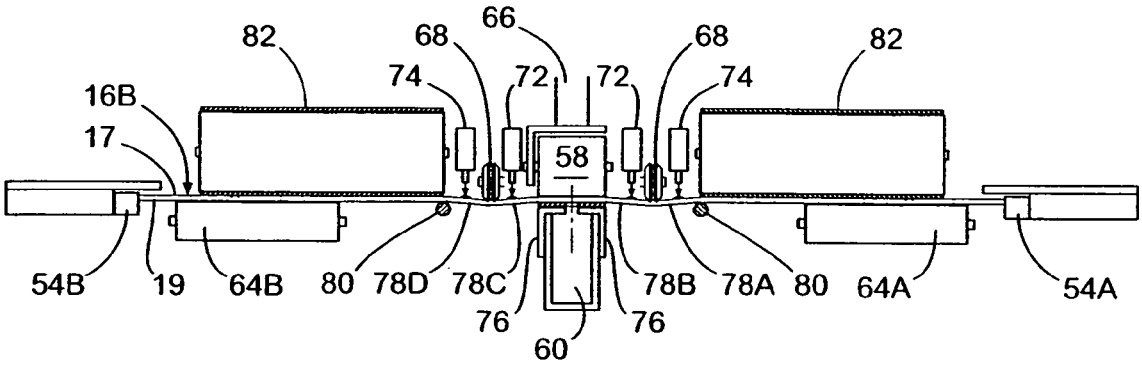
FIGS. 7A-C are cross sectional views taken along lines 7A-7A, 7B-7B and 7C-7C respectively of the machine of FIG. 1A which shows the corrugated blank at different stages of deformation for forming the struts in the blank.
Figure 7B:
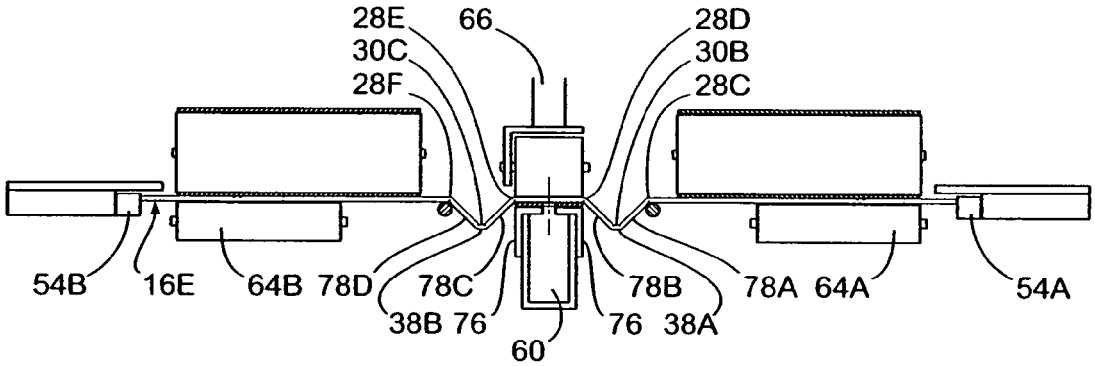
Figure 7C:
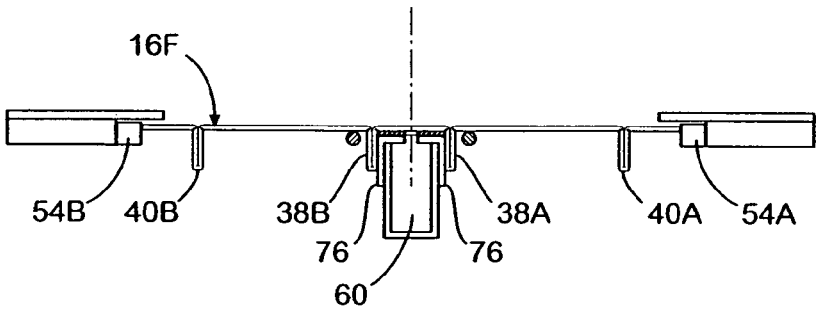

A plurality of creasing wheels 68 may be placed above the corrugated blank 16B where each strut is to be formed to commence the deformation of the strut as illustrated in FIG. 7A-C. These creasing wheels 68 start the deformation of the corrugated paperboard to form the strut with the final deformation completed by the compression exerted on the sides 53A-B of the corrugated blank 16B. An L shaped anvil 76 is provided for forming one side of the strut as illustrated in FIGS. 5A and 7A-C. The weakened lines 28A-H in the corrugated blank 16B as illustrated in FIG. 2B on the top sheet 17 are bent at 90° to form each leg 78A-D of the struts 38A-B as illustrated in FIG. 7A-B. Corresponding weakened lines on the bottom sheet 19 assist in forming the 90° angle between the corrugated blank 16B and each leg 78A-D of the struts 38A-B. The 180° weakened line 30B in the top sheet 17 of the corrugated blank 16B helps form the 180° angle between the two legs, e.g. 78A-B of a strut 38A.

An overhead roller bed 58 is provided above each L shaped anvil 76 to hold the corrugated blank 16B in the same plane and to assist in forming the 90° angle for forming each leg 78A-D of the struts 38A-B. It should be realized that a plate or belt could be used in place of the overhead roller bed 58.

The creasing wheels 68 are supported by a creasing wheel and glue applicator mounting bracket 70 as shown in FIGS. 5A-B. As the struts, such as 38A-B, are being formed, hot melt and cold glue is applied to the inside surface of the legs 78A-D by cold glue applicators 72 and hot melt glue applicators 74 supported by bracket 70. Both hot melt and cold glue are applied so that the glue is set up quickly in one step so it will hold the legs 78A-B and 78C-D together. The legs 78A-D of the struts 38A-B are held together by the compression chains 54A-B as the blank 16B is conveyed through the machine 10 to allow the glue to set up and hold the struts together. A rod 80 can be provided to hamper vibration of the blank 16B as the struts are formed.

Figure 2F:
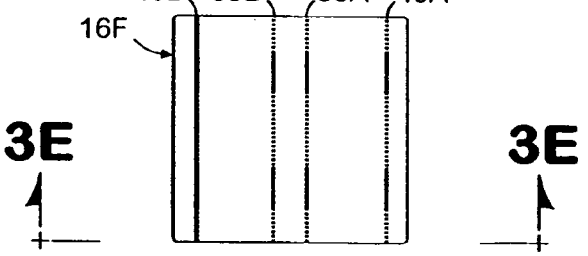

The first strut forming section 34 forms struts 38A-B, which are the inner set of struts. After the inner struts 34A-B are formed, the corrugated blank 16B is picked up by conveyor feed belt 44 and conveyed into the second strut forming section 36 in which the outer set of struts 40A-B are formed in the same fashion as the inner struts 38A-B were formed in first strut forming section 34. The corrugated panel 16F shown in FIG. 2F formed from the corrugated blank 16B then exits the back of the machine 55B. Both a top and bottom panel can be formed on this machine 10. This machine 10 is able to form struts so they are at a 90° to the corrugated blank 16 by reducing the latitudinal width L between the sides 53A-B at the same time as the strut is being formed by folding against the anvil 76. A top panel and bottom panel can then be assembled to produce the corrugated pallet. This assembly involves the placement of the two panels together and gluing at strategic places.

While this machine 10 is set up to produce a top or bottom panel with four struts a machine can be designed to produce six or more struts. It should also be recognized that a top or bottom panel with only two struts could be used by only using the first folding and gluing section 34 of the machine 10 or designing a machine that only had one folding and gluing section.

It should be appreciated that the compression chains 54A-B significantly reduce the distance between the sides 53A-B of the blank 16B from start to finish. For example, for many pallets it is common to have a strut that has two legs that are 3.75 inches in height which would utilize 7.5 inches of the corrugated paperboard blank for each strut. Thus, with four struts in a top or bottom panel and starting with a paperboard blank 16B that was 78 inches wide, the width of the blank between the sides 53A-B would be reduced to 48 inches.

The corrugated panel forming machine 10 of this invention can be adjusted to vary the latitudinal L distance between the anvils 76 and other mechanisms of the machine that form the struts. The creasing wheel and glue mounting brackets 70 can be attached to an adjustable overhead carriage 66 for moving back and forth in the latitudinal direction to form the struts in different areas. The L shaped anvil 76 and conveyor feed belts 42, 44 are also attached to this adjustable overhead carriage and can be moved in the latitudinal direction as well. The latitudinal L distance can be adjusted for both the first and second folding and gluing sections as shown in FIGS. 5A-B The corrugated blank 16A shown in FIG. 2 is designed to have the struts run from one end E to the other end E' of the panel, except for apertures for a fork lift. A pallet can be constructed without any apertures for a forklift in which case the struts run continuously from one end E to the panel 16F to the other end E'. A cross section of the corrugated blanks at each phase of the construction is illustrated in FIG. 3A-E. The strut forming sections 14 of the machine 10 can be inverted so the struts 38A-B, as shown in FIG. 3, extend upward rather than down.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

Therefore, having thus described the invention, at least the following is claimed:

1. A folding and gluing machine for converting a sheet like corrugated blank having a top, bottom, two sides and two ends into the top or bottom corrugated panel for a corrugated pallet, with each panel having at least two spaced apart parallel struts, with each strut having two legs formed in the area between weakened lines impressed in the blank by folding and gluing the two legs together, with each strut being perpendicular to the panel and extending from one end of the panel to the other, said machine comprising:

conveying means for conveying the blank through the machine along a given path, said machine having a folding and gluing section with an elongate anvil for forming each strut, said anvil extending in a longitudinal direction along said path, said machine having two side means to exert pressure on the sides of the corrugated blank as it is conveyed through the machine, said side means of the machine being tapered inwardly from the front to the end of the folding and gluing section to force the corrugated blank to form each strut against said anvil along the weakened lines in the blank, said machine having means to commence the formation of each strut by pushing the area of the blank between the weakened lines out of the plane of the blank and having means to hold the rest of the blank in a single plane during the compression by the side means of the machine, said machine having a gluing means to apply glue to each leg of each strut to hold the strut together, in which the side means to exert pressure on the sides of the corrugated blank is a chain positioned on each side of the machine which is designed to run in a longitudinal direction with the blank along the given path through the folding and gluing section, with said chain being constructed of a plurality of lugs attached together, with each lug having a side facing inwardly into the machine, with the inward side of at least a substantial number of such lugs having a groove designed to stay in contact with the side of a blank during its formation into a panel in the folding and gluing section of the machine, with the chains exerting pressure on the sides of the blank to form the struts against the anvils.

2. A folding and gluing machine for converting a sheet like corrugated blank having a top, bottom, two sides and two ends into the top or bottom corrugated panel for a corrugated pallet, with each panel having at least two spaced apart parallel struts, with each strut having two legs formed in the area between weakened lines impressed in the blank by folding and gluing the two legs together, with each strut being perpendicular to the panel and extending from one end of the panel to the other, said machine comprising:

conveying means for conveying the blank through the machine along a given path, said machine having a folding and gluing section with an elongate anvil for forming each strut, said anvil extending in a longitudinal direction along said path, said machine having two side means to exert pressure on the sides of the corrugated blank as it is conveyed through the machine, said side means of the machine being tapered inwardly from the front to the end of the folding and gluing section to force the corrugated blank to form each strut against said anvil along the weakened lines in the blank, said machine having means to commence the formation of each strut by pushing the area of the blank between the weakened lines out of the plane of the blank and having means to hold the rest of the blank in a single plane during the compression by the side means of the machine, said machine having a gluing means to apply glue to each leg of each strut to hold the strut together, which also has a slitting section for making the weakened lines in a blank in advance of the blank entering the folding and gluing section of the machine, the slitting section having two pairs of parallel rollers, with each roller having forming dies around its circumference that are aligned with forming dies on the other roller in the pair for making the weakened lines in the blank to facilitate the folding of the struts, with one pair of rollers having dies for making the weakened lines for forming a 90 degree angle in the blank for folding one portion of the blank into one leg of each perpendicular strut, and the other pair of rollers having dies for making two parallel weakened lines for facilitating the forming of an 180 degree angle in the center of each strut between the two legs, the machine having conveying means to move the blank between the slitting section and the folding and gluing section of the machine.

3. A folding and gluing machine for converting a sheet like corrugated blank having a top, bottom, two sides and two ends into the top or bottom corrugated panel for a corrugated pallet, with each panel having at least two spaced apart parallel struts, with each strut having two legs formed in the area between weakened lines impressed in the blank by folding and gluing the two legs together, with each strut being perpendicular to the panel and extending from one end of the panel to the other, said machine comprising:

conveying means for conveying the blank through the machine along a given path, said machine having a folding and gluing section with an elongate anvil for forming each strut, said anvil extending in a longitudinal direction along said path, said machine having two side means to exert pressure on the sides of the corrugated blank as it is conveyed through the machine, said side means of the machine being tapered inwardly from the front to the end of the folding and gluing section to force the corrugated blank to form each strut against said anvil along the weakened lines in the blank, said machine having means to commence the formation of each strut by pushing the area of the blank between the weakened lines out of the plane of the blank and having means to hold the rest of the blank in a single plane during the compression by the side means of the machine, said machine having a gluing means to apply glue to each leg of each strut to hold the strut together, in which the means to push the area between the weakened lines in the blank out of the plane of the blank is a plurality of creasing wheels for exerting pressure on this area as the blank passes through the folding and gluing section, and in which each anvil has a top and edge against which a strut is formed in the blank, with a plurality of rollers being located above the top of the anvil in the longitudinal direction of the machine so a portion of the blank is held between the rollers and the top of the anvil while a strut is being folded against the anvil as the blank passes through the folding and gluing section of the machine.

4. The machine of claim 3, in which the means to push the area between the weakened lines in the blank out of the plane of the blank is a plurality of creasing wheels for exerting pressure on this area as the blank passes through the folding and gluing section.

5. The machine of claim 3, in which a rod is provided in a longitudinal direction near each anvil to minimize vibration of the blank as it is being folded into a top or bottom panel.

6. A folding and gluing machine for converting a sheet like corrugated blank having a top, bottom, two sides and two ends into the top or bottom corrugated panel for a corrugated pallet, with each panel having at least two spaced apart parallel struts, with each strut having two legs formed in the area between weakened lines impressed in the blank by folding and gluing the two legs together, with each strut being perpendicular to the panel and extending from one end of the panel to the other, said machine comprising:

conveying means for conveying the blank through the machine along a given path, said machine having a folding and gluing section with an elongate anvil for forming each strut, said anvil extending in a longitudinal direction along said path, said machine having two side means to exert pressure on the sides of the corrugated blank as it is conveyed through the machine, said side means of the machine being tapered inwardly from the front to the end of the folding and gluing section to force the corrugated blank to form each strut against said anvil along the weakened lines in the blank, said machine having means to commence the formation of each strut by pushing the area of the blank between the weakened lines out of the plane of the blank and having means to hold the rest of the blank in a single plane during the compression by the side means of the machine, said machine having a gluing means to apply glue to each leg of each strut to hold the strut together, in which the machine has two folding and gluing sections in a longitudinal arrangement along the given path through the machine and each folding and gluing section has two parallel anvils for forming two struts in the blank, and in which the side means to exert pressure on the sides of the corrugated blank is at least one chain positioned on each side of the machine which is designed to run in a longitudinal direction with the blank along the given path through the folding and gluing sections, with each chain being constructed of a plurality of lugs attached together, with each lug having a side facing inwardly into the machine, with the inward side of at least a substantial number of such lugs having a groove designed to stay in contact with the side of a blank during its formation into a panel in the folding and gluing sections of the machine, with the chains exerting pressure on the sides of the blank to form the struts against the anvils.

7. A folding and gluing machine for converting a sheet like corrugated blank having a top, bottom, two sides and two ends into the top or bottom corrugated panel for a corrugated pallet, with each panel having at least two spaced apart parallel struts, with each strut having two legs formed in the area between weakened lines impressed in the blank by folding and gluing the two legs together, with each strut being perpendicular to the panel and extending from one end of the panel to the other, said machine comprising:

conveying means for conveying the blank through the machine along a given path, said machine having a folding and gluing section with an elongate anvil for forming each strut, said anvil extending in a longitudinal direction along said path, said machine having two side means to exert pressure on the sides of the corrugated blank as it is conveyed through the machine, said side means of the machine being tapered inwardly from the front to the end of the folding and gluing section to force the corrugated blank to form each strut against said anvil along the weakened lines in the blank, said machine having means to commence the formation of each strut by pushing the area of the blank between the weakened lines out of the plane of the blank and having means to hold the rest of the blank in a single plane during the compression by the side means of the machine, said machine having a gluing means to apply glue to each leg of each strut to hold the strut together, in which the machine has two folding and gluing sections in a longitudinal arrangement along the given path through the machine and each folding and gluing section has two parallel anvils for forming two struts in the blank, and which also has a slitting section for making the weakened lines in a blank in advance of the blank entering the first folding and gluing section of the machine, the slitting section having two pairs of parallel rollers, with each roller having forming dies around its circumference that are aligned with forming dies on the other roller in the pair for making the weakened lines in the blank to facilitate the folding of the struts, with one pair of rollers having dies for making the weakened lines for forming a 90 degree angle in the blank for folding one portion of the blank into one leg of each perpendicular strut, and the other pair of rollers having dies for making two parallel weakened lines for facilitating the forming of an 180 degree angle in the center of each strut between the two legs of the strut, the machine having conveying means to move the blank between the slitting section and the first folding and gluing section of the machine.

8. A folding and gluing machine for converting a sheet like corrugated blank having a top, bottom, two sides and two ends into the top or bottom corrugated panel for a corrugated pallet, with each panel having at least two spaced apart parallel struts, with each strut having two legs formed in the area between weakened lines impressed in the blank by folding and gluing the two legs together, with each strut being perpendicular to the panel and extending from one end of the panel to the other, said machine comprising:

conveying means for conveying the blank through the machine along a given path, said machine having a folding and gluing section with an elongate anvil for forming each strut, said anvil extending in a longitudinal direction along said path, said machine having two side means to exert pressure on the sides of the corrugated blank as it is conveyed through the machine, said side means of the machine being tapered inwardly from the front to the end of the folding and gluing section to force the corrugated blank to form each strut against said anvil along the weakened lines in the blank, said machine having means to commence the formation of each strut by pushing the area of the blank between the weakened lines out of the plane of the blank and having means to hold the rest of the blank in a single plane during the compression by the side means of the machine, said machine having a gluing means to apply glue to each leg of each strut to hold the strut together, in which the machine has two folding and gluing sections in a longitudinal arrangement along the given path through the machine and each folding and gluing section has two parallel anvils for forming two struts in the blank, and in which each anvil has a top and edge against which a strut is formed in the blank, with a plurality of rollers being located above the top of the anvil in the longitudinal direction of the machine so the blank is held between the rollers and the top of the anvil while a strut is being folded against the anvil as the blank passes through a folding and gluing section of the machine.

9. The machine of claim 8, in which the means to hold the corrugated blank in a single plane, except for the struts, during the compression by the side means of the machine is a combination of conveyers, vacuum orifices and plates, along with the rollers located above the top of each of the anvils, all of which are directed to hold the blank in a single plane during compression.

10. A folding and gluing machine for converting a sheet like corrugated blank having a top, bottom, two sides and two ends into the top or bottom corrugated panel for a corrugated pallet, with each panel having four spaced apart parallel struts, with each strut formed along weakened lines formed in the blank by folding and gluing two portions of the blank between the weakened lines together, with each strut being perpendicular to the panel and extending from one end of the panel to the other, said machine comprising:

conveying means for conveying the blank through the machine along a given path, said machine having two folding and gluing sections, with each section having two elongate anvils for forming two struts, each said anvil extending in a longitudinal direction along said path, said machine having two side means to exert pressure on the sides of the corrugated blank is conveyed through the folding and gluing sections, said side means of the machine being tapered inwardly from the front to the end of the folding and gluing section to force the corrugated blank to form each strut against said anvil along the weakened lines in the blank, said machine having means to commence the formation of each strut by pushing the area of the blank between the weakened lines out of the plane of the blank and means to hold the rest of the corrugated blank in single plane during the compression by the side means of the machine, said machine having a gluing means to apply glue to the areas of the corrugated blank where each strut is formed to hold the strut together, in which the means to push the area between the weakened lines in the blank out of the plane of the blank is a plurality of creasing wheels for exerting pressure on this area as the blank passes through the folding and gluing section, and in which the side means to exert pressure on the sides of the corrugated blank is at least one chain positioned on each side of the machine which is designed to run in a longitudinal direction with the blank along the path through the folding and gluing sections, with each chain being constructed of a plurality of lugs attached together, with each lug having a side facing inwardly into the machine, with the inward side of at least a substantial number of such lugs having a groove designed to stay in contact with the side of a blank during its formation into a panel in the folding and gluing sections of the machine, with the chains exerting pressure on the sides of the blank to form the struts against the anvils, and in which each anvil has a top and edge against which a strut is formed in the blank, with a plurality of wheels being located above the top of the anvil in the longitudinal direction of the machine so the blank is held between the wheels and the top of the anvil while a strut is being folded against the anvil as the blank passes through a folding and gluing section of the machine.

11. A folding and gluing machine for converting a sheet like corrugated blank having a top, bottom, two sides and two ends into the top or bottom corrugated panel for a corrugated pallet, with each panel having four spaced apart parallel struts, with each strut formed along weakened lines formed in the blank by folding and gluing two portions of the blank between the weakened lines together, with each strut being perpendicular to the panel and extending from one end of the panel to the other, said machine comprising:

conveying means for conveying the blank through the machine along a given path, said machine having two folding and gluing sections, with each section having two elongate anvils for forming two struts, each said anvil extending in a longitudinal direction along said path, said machine having two side means to exert pressure on the sides of the corrugated blank as it is conveyed through the folding and gluing sections, said side means of the machine being tapered inwardly from the front to the end of the folding and gluing section to force the corrugated blank to form each strut against said anvil along the weakened lines in the blank, said machine having means to commence the formation of each strut by pushing the area of the blank between the weakened lines out of the plane of the blank and means to hold the rest of the corrugated blank in single plane during the compression by the side means of the machine, said machine having a gluing means to apply glue to the areas of the corrugated blank where each strut is formed to hold the strut together, in which the means to push the area between the weakened lines in the blank out of the plane of the blank is a plurality of creasing wheels for exerting pressure on this area as the blank passes through the folding and gluing section, and which also has a slitting section for making the weakened lines in a blank in advance of the blank entering the first folding and gluing section of the machine, the slitting section having two pairs of parallel rollers, with each roller having forming dies around its circumference that are aligned with forming dies on the other roller in the pair for making the weakened lines in the blank to facilitate the folding of the struts, with one pair of rollers having dies for making the weakened lines for forming a 90 degree angle in the blank for folding one portion of the blank into one leg of each perpendicular strut, and the other pair of rollers having dies for making two parallel weakened lines for facilitating the forming of an 180 degree angle in the center of each strut between the two legs, the machine having conveying means to move the blank between the slitting section and the first folding and gluing section of the machine.

12. A folding and gluing machine for converting a sheet like corrugated blank having a top, bottom, two sides and two ends into the top or bottom corrugated panel for a corrugated pallet, with each panel having four spaced apart parallel struts, with each strut formed along weakened lines formed in the blank by folding and gluing two portions of the blank between the weakened lines together, with each strut being perpendicular to the panel and extending from one end of the panel to the other, said machine comprising:

conveying means for conveying the blank through the machine along a given path, said machine having two folding and gluing sections, with each section having two elongate anvils for forming two struts, each said anvil extending in a longitudinal direction along said path, said machine having two side means to exert pressure on the sides of the corrugated blank as it is conveyed through the folding and gluing sections, said side means of the machine being tapered inwardly from the front to the end of the folding and gluing section to force the corrugated blank to form each strut against said anvil along the weakened lines in the blank, said machine having means to commence the formation of each strut by pushing the area of the blank between the weakened lines out of the plane of the blank and means to hold the rest of the corrugated blank in single plane during the compression by the side means of the machine, said machine having a gluing means to apply glue to the areas of the corrugated blank where each strut is formed to hold the strut together, in which the means to push the area between the weakened lines in the blank out of the plane of the blank is a plurality of creasing wheels for exerting pressure on this area as the blank passes through the folding and gluing section, and in which each anvil has a top and edge against which a strut is formed in the blank, with a plurality of rollers being located above the top of the anvil in the longitudinal direction of the machine so a portion of the blank is held between the rollers and the top of the anvil while a strut is being folded against the anvil as the blank passes through the folding and gluing section of the machine.

13. The machine of claim 12, in which the means to hold the corrugated blank in a single plane, except for the struts, during the compression by the side means of the machine is a combination of conveyers, vacuum orifices and plates, along with the rollers located above the top of each of the anvils, all of which are directed to hold the blank in a single plane during compression.

* * * * *